US008708155B2

(12) United States Patent
Zubovich

(10) Patent No.: US 8,708,155 B2
(45) Date of Patent: Apr. 29, 2014

(54) ORE SCREENING PANEL FRAME COVER

(75) Inventor: Jeff Zubovich, Sunshine (AU)

(73) Assignee: Schenck Process Australia Pty Limited, New South Wales (AU)

( * ) Notice: Subject to any disclaimer, the term of this patent is extended or adjusted under 35 U.S.C. 154(b) by 505 days.

(21) Appl. No.: 12/350,428

(22) Filed: Jan. 8, 2009

(65) Prior Publication Data

US 2009/0184032 A1 Jul. 23, 2009

(30) Foreign Application Priority Data

Jan. 18, 2008 (AU) ..... 2008900237

(51) Int. Cl.
*B07B 1/49* (2006.01)

(52) U.S. Cl.
USPC ..... 209/405; 209/399; 209/409

(58) Field of Classification Search
USPC ..... 209/363, 405, 412, 395, 399, 403, 409, 209/411
See application file for complete search history.

(56) References Cited

U.S. PATENT DOCUMENTS

| | | | | |
|---|---|---|---|---|
| 5,372,261 | A * | 12/1994 | Galton et al. | 209/399 |
| 5,377,846 | A * | 1/1995 | Askew | 209/405 |
| 5,755,334 | A * | 5/1998 | Wojcik et al. | 209/399 |
| 7,731,035 | B2 * | 6/2010 | Zubovich et al. | 209/405 |
| 2004/0245155 | A1 * | 12/2004 | Strong et al. | 209/405 |
| 2011/0180461 | A1 * | 7/2011 | Lane et al. | 209/405 |

FOREIGN PATENT DOCUMENTS

| | | |
|---|---|---|
| AU | 72663/74 | 2/1976 |
| AU | 23 719/77 B1 | 3/1977 |
| AU | 556953 | 3/1983 |
| AU | 559443 | 6/1984 |
| AU | 700843 | 5/1996 |
| AU | 711096 | 1/1998 |
| AU | 742060 | 6/1999 |
| AU | 755595 | 8/2000 |

* cited by examiner

*Primary Examiner* — Joseph C Rodriguez
*Assistant Examiner* — Kalyanavenkateshware Kumar
(74) *Attorney, Agent, or Firm* — Novak Druce Connolly Bove + Quigg LLP

(57) ABSTRACT

An ore screening deck frame system which consists of a machine frame having a machine attachment portion and a panel attachment portion having holes spaced along the length there of and a cover which is adapted to extend parallel to the panel attachment support portion has dependent edge skirts that depend below the surface of the panel attachment support portion and also has dependent tubular bosses spaced to fit in the holes of said panel attachment support portion. The frame is made from an inverted L section steel frame member with the upper flange providing the panel attachment support portion. The cover is molded from polyurethane or rubber and encloses the upper flange. The tubular bosses extend from recesses in the surface of the cover and the recesses incorporate an annular shoulder that corresponds to the top of the tubular bosses. The tubular bosses are adapted to receive fastening pins that extend into the bosses and end below the lower surface of the upper flange.

5 Claims, 4 Drawing Sheets

ORE SCREENING PANEL FRAME COVER

CROSS REFERENCE TO RELATED APPLICATIONS

This nonprovisional application claims priority under 35 U.S.C. §119(a) on Patent Application No. 2008900237 filed in Australia on Jan. 18, 2008, the entire contents of which are hereby incorporated by reference This invention relates to covers for frames for use in vibratory screening machines of the type used in mining and quarrying.

BACKGROUND TO THE INVENTION

Australian patent 482212 proposed a modular screening panel system for ore screening decks which is now widely used by the mining industry and replaced the earlier screening cloths, and large wire screening frames. The screening panels were all of the same size [e.g. 300 mm] and made of reinforced polyurethane. The panels are adapted to be secured to an underlying support frame using dependent spigots which are a force fit into corresponding apertures in the support frame. The underlying support frame was designed specifically for the panels and itself was secured to the machine frame fitted as original equipment by the screening machine manufacturer.

A variety of methods have evolved for securing modular panels to the screening machines which use pin expanded spigots or edge flanges and all require complementary support frames which need to be assembled to the machine frame. Typical embodiments of these various systems are disclosed in patents 517319, 556953, 559443, 700843, 711096, 74,060 and 755595. The machine frame supplied as original equipment for the screening machines to which the support frames for the screening panels is fitted is usually an inverted L section in which the upper horizontal flange has bolt holes along its length so that the support frames can be secured. Thus in installing a screening deck the support frames must first be assembled and bolted in place before the panels can be fitted.

The machine frame is subjected to erosion and corrosion by the fines and other corrosive liquids passing over the frames during the screening operation. No. 699,604 proposed a deflector plate of polyurethane be secured between the support frame and the machine frame to address this problem.

Australian patent 2006200441 discloses a machine frame having a machine attachment portion and a support rail attachment portion and a panel support rail having a frame attachment portion and a panel attachment portion where in the rail attachment portion of the frame and the frame attachment portion of the rail are in end view cross section of a complementary shape so that the frame and rail can be locked together. This encapsulates the machine frame in wear resistant material such as polyurethane or rubber.

It is an object of this invention to improve the speed of assembly of screening decks and also increase the wear life of the machine frames.

BRIEF DESCRIPTION OF THE INVENTION

To this end the present invention provides an ore screening deck frame system which consists of a machine frame having a machine attachment portion and a panel attachment support portion having holes spaced along the length there of and a cover which is adapted to extend parallel to the panel attachment support portion has dependent edge skirts that depend below the surface of the panel attachment support portion and also has dependent tubular bosses spaced to fit in the holes of said panel attachment support portion.

The frame is preferably made from an inverted L section steel frame member with the upper flange providing the panel attachment support portion. The cover is preferably moulded from polyurethane or rubber and encloses the upper flange. The tubular bosses extend from recesses in the surface of the cover and the recesses incorporate an annular shoulder that corresponds to the top of the tubular bosses. The tubular bosses are adapted to receive fastening pins that extend into the bosses and end below the lower surface of the upper flange.

This arrangement eliminates the use of metal bolt fasteners for the frame cover and thus eliminates another component subject to corrosion.

Because the cover is polyurethane or rubber which is the same material commonly used to form the modular screening panels the useful life of the machine frame is extended.

DETAILED DESCRIPTION OF THE INVENTION

A preferred embodiment of the invention will be described with reference to the drawings in which.

Figure 1:
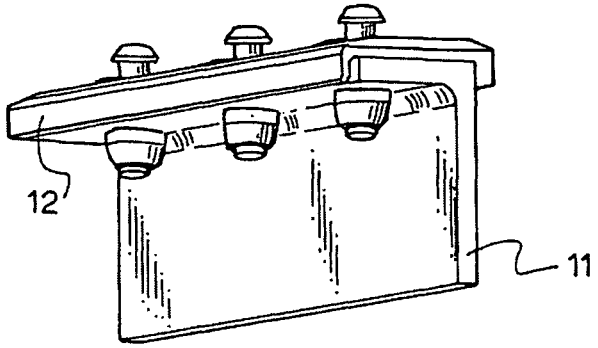
FIG. 1 is a perspective view of a frame member and cover according to a first embodiment of the invention.
Figure 2:
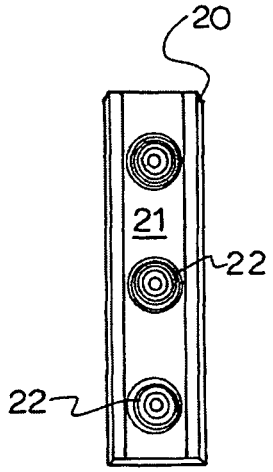
FIG. 2 is a plan view of the frame member of FIG. 1.
Figure 3:
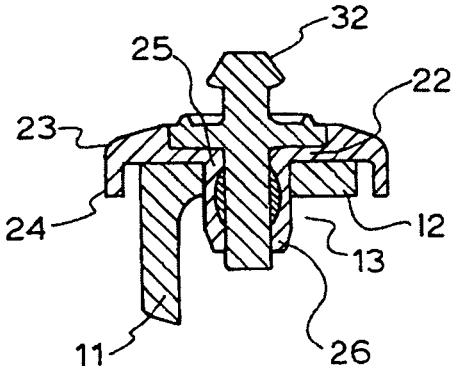
FIG. 3 is an end section view of the frame member of FIG. 1.

As seen in FIGS. 1 to 5 the machine frame member consists of a vertical web 11 and a horizontal flange 12 having holes 13 spaced along its length.

The frame cover 20 consists of longitudinal body 21 having a circular recess 22. The top surface of cover 20 is flat but the edges 23 are chamfered and incline downwardly to dependent vertical skirts 24. The recess 22 incorporates an annular shoulder 25 from which a tubular boss 26 depends downwardly. The bosses 26 are spaced to coincide with the holes 13 in flange 12 and extend beyond the lower surface of flange 12.

Figure 4:
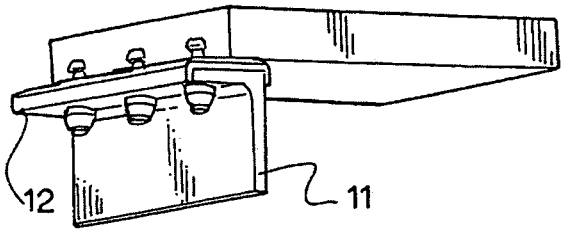
FIG. 4 is a perspective view of the frame member of FIG. 1 and a panel.
Figure 5:
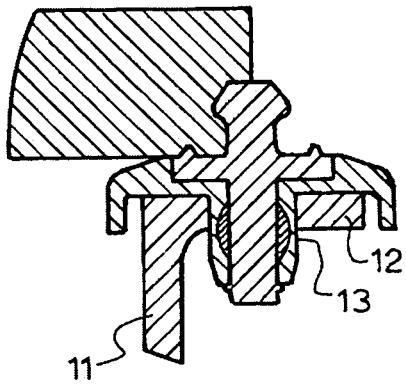
FIG. 5 is an end section view of FIG. 4.

Fastening pins 32 of the kind described in Australian patent 2002300432 are a force fit in the tubular bosses to secure the cover and themselves to the frame member. As shown in FIGS. 4 and 5, the pins 32 fit within recesses in the screening panels and hold two abutting panels to the frame member.

Figure 6:
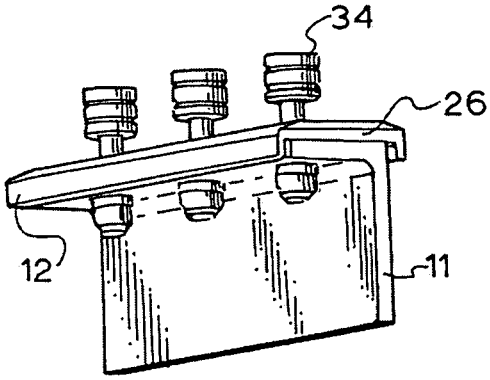
FIG. 6 is a perspective view of a frame member and cover according to a second embodiment of the invention.
Figure 7:
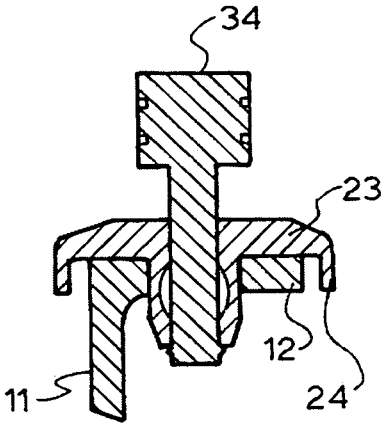
FIG. 7 is an end section view of FIG. 6.

In FIGS. 6 and 7 conventional headed pins 34 are shown which bear down on the edges of screening panels.

Figure 8:
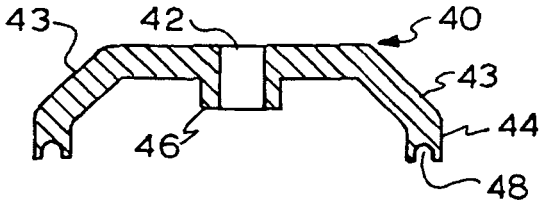
FIG. 8 is an end section view of a cover member according to an embodiment of this invention.
Figure 9:
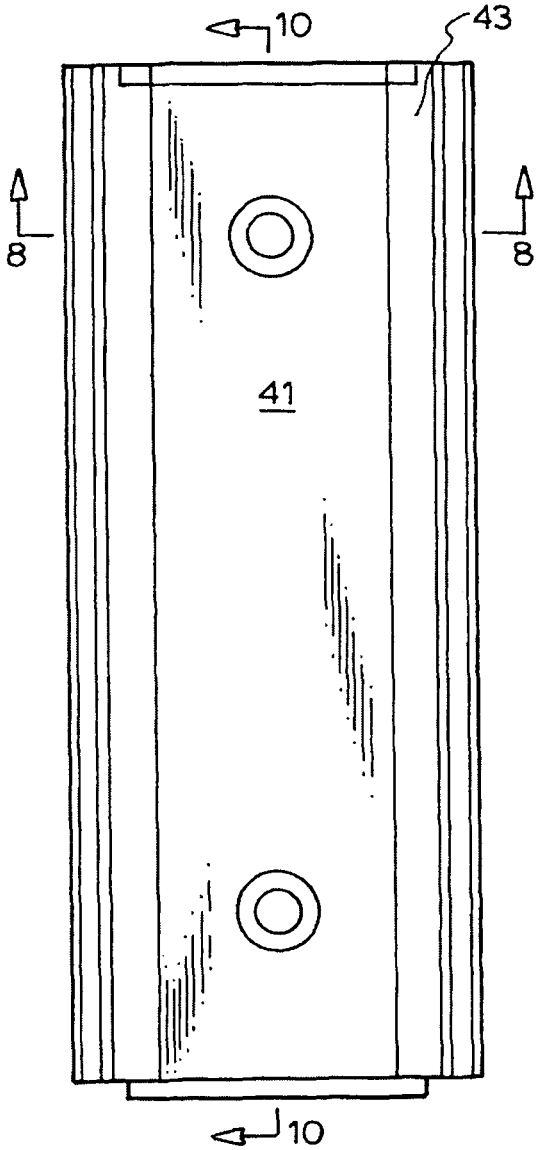
FIG. 9 is a plan view of the cover of FIG. 8.
Figure 10:
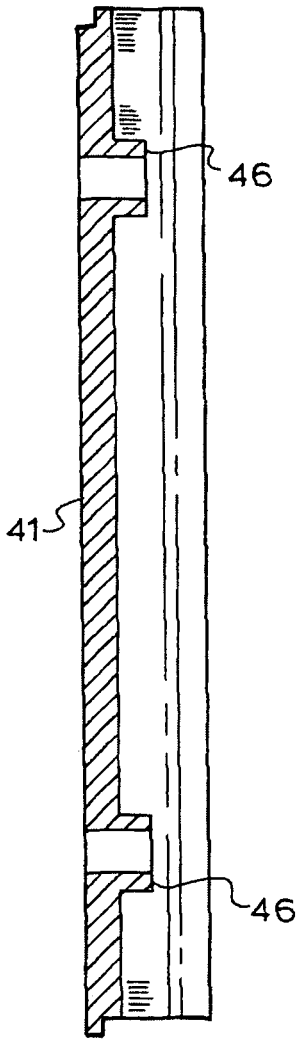
FIG. 10 is a side section view of the cover of FIG. 8.

In the embodiment of FIGS. 8 to 10 the frame cover 40 consists of longitudinal body 41 having a circular hole 42. The top surface of cover 40 is flat with inclined side extensions 43 ending in dependent vertical skirts 44. The hole 42 extends into a tubular boss 46 which depends downwardly. The bosses 46 are spaced to coincide with the holes 13 in flange 12 and extend beyond the lower surface of flange 12.

The radiused edges 48 are designed to ensure that any fines are not retained on the cover as this edge shape encourages drop formation when slurried materials are being screened.

Figure 11:
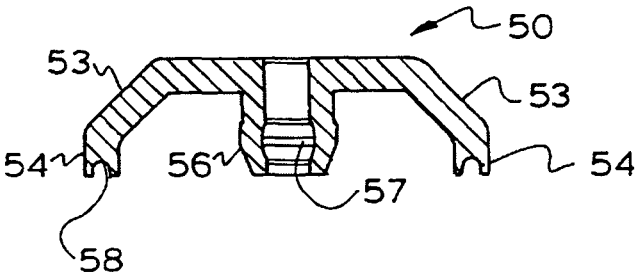
FIG. 11 is an end section view of a cover member according to another embodiment of this invention.
Figure 12:
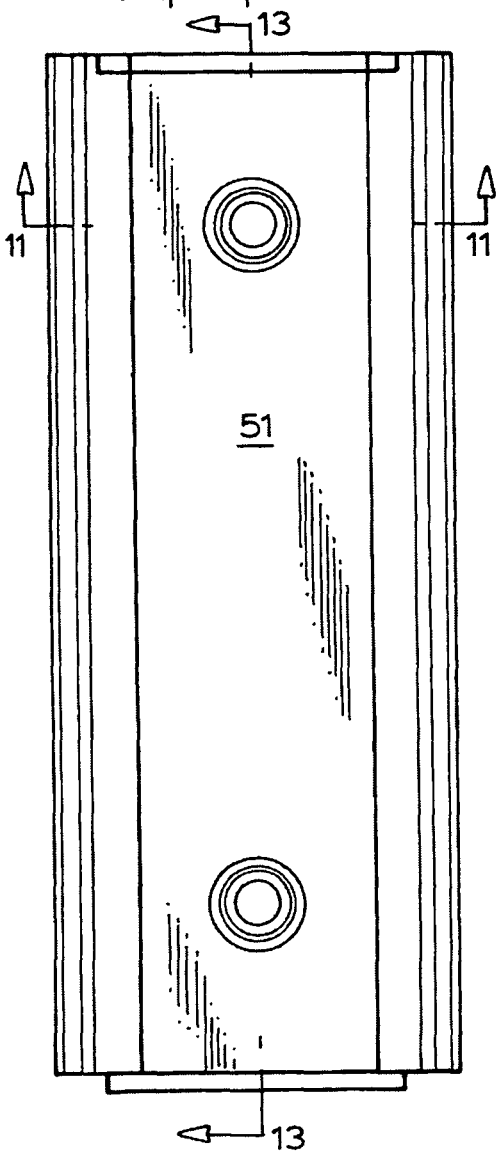
FIG. 12 is a plan view of the cover of FIG. 11.
Figure 13:
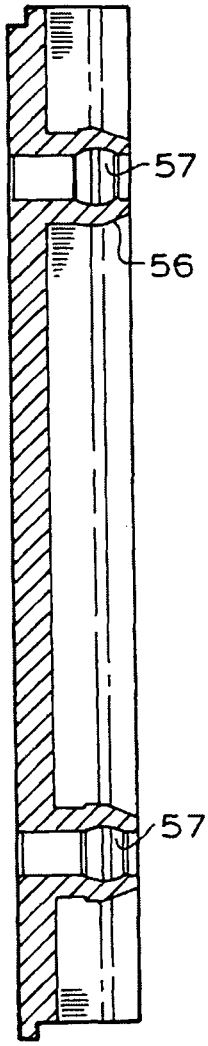
FIG. 13 is a side section view of the cover of FIG. 11.

In the embodiment of FIGS. 11 to 13 the frame cover 50 consists of longitudinal body 51 having a circular hole 52. The top surface of cover 50 is flat with inclined side extensions 53 ending in dependent vertical skirts 54. The hole 52 extends into a tubular boss 56 which depends downwardly and incorporates an annular retention recess 57 for retaining a headed spigot. The bosses 56 are spaced to coincide with the holes 13 in flange 12 and extend beyond the lower surface of flange 12. Again the radiussed edge 58 is used.

From the above it can be seen that this invention provides a machine frame cover can easily accommodate a wide range of panel attachments systems without the need for time consuming rail assembly as no bolting is required and no special tools are required.

Those skilled in the art will realize that this invention has been described with reference to one particular embodiment but may be implemented with other shapes for the rail support portion of the machine frame.

The invention claimed is:

1. An ore screening deck frame system comprising:

a machine frame having a machine attachment portion and a panel attachment support portion, the panel attachment support portion having holes spaced along the length thereof; and a cover adapted to extend parallel to the panel attachment support portion which also includes dependent edge skirts spaced a distance away from the panel attachment portion to incline downwardly below the surface of the panel attachment support portion, and dependent tubular bosses spaced to fit in the holes of the panel attachment support portion and extend beyond a lower surface of the panel attachment support portion.

2. An ore screening deck frame system as claimed in claim 1 in which the frame is made from an inverted L section steel frame member with an upper flange providing the panel attachment support portion.

3. An ore screening deck frame system as claimed in claim 1 in which the cover is moulded from polyurethane or rubber and encloses the upper flange.

4. An ore screening deck frame system as claimed in claim 1 in which the tubular bosses are adapted to receive fastening pins that extend into the bosses and end below the lower surface of the upper flange, said bosses extend from recesses in the surface of the cover and the recesses incorporate an annular shoulder that corresponds to the top of the tubular bosses.

5. An ore screening deck frame system for attachment to a machine frame having a vertical web and a horizontal flange including holes along its length, said system comprising, a panel attachment portion mounted to a machine attachment portion, the machine attachment portion consisting of a cover, adapted to extend parallel to the panel attachment portion, having dependent edge skirts that depend below the surface of the panel attachment portion, said cover having holes spaced along the length thereof and dependent tubular bosses extending from said holes in said cover, wherein said tubular bosses are spaced to fit in the holes of said machine frame.

* * * * *